US005447085A

United States Patent [19]

Gochnauer

[11] Patent Number: 5,447,085

[45] Date of Patent: Sep. 5, 1995

[54] TABLE SAW ACCESSORIES FOR IMPROVED OPERABILITY

[76] Inventor: Marshall Gochnauer, 1311 Delaware Ave., SW., Washington, D.C. 20024

[21] Appl. No.: 208,304

[22] Filed: Mar. 10, 1994

[51] Int. Cl.[6] ..... B27B 27/02; B27G 19/08

[52] U.S. Cl. ..... 83/102.1; 83/438; 83/477.2; 144/253 H

[58] Field of Search ..... 83/102, 102.1, 162, 83/166, 279, 438, 443, 467.1, 468.7, 477.2, 441, 441.1; 144/253 J, 253 H, 253 G, 253 C; D19/65

[56] References Cited

U.S. PATENT DOCUMENTS

| | | | |
|---|---|---|---|
| 129,193 | 7/1872 | Tompkins | 83/102.1 |
| D 132,430 | 5/1942 | Rosenberg | D19/65 |
| 227,287 | 5/1880 | Murley | 83/102.1 |
| 453,893 | 6/1891 | Smith | 83/438 |
| 482,507 | 9/1892 | Foster | 83/102.1 |
| 545,504 | 9/1895 | Hoover | 83/102.1 |
| 565,940 | 8/1896 | Stevens et al. | 83/102.1 |
| 615,833 | 12/1898 | Fisher | 83/102.1 |
| 3,911,531 | 10/1975 | Buturuga | D19/65 X |
| 4,332,060 | 6/1982 | Sato | D19/65 X |
| 5,016,693 | 5/1991 | Haffely et al. | 144/253 J |
| 5,143,128 | 9/1992 | Chen | 144/253 G X |
| 5,301,726 | 4/1994 | Wojcik | 14/253 J |
| 5,325,900 | 7/1994 | Garuglieri | 144/253 J |

*Primary Examiner*—Rinaldi I. Rada
*Assistant Examiner*—Clark F. Dexter
*Attorney, Agent, or Firm*—Popham, Haik, Schnobrich & Kaufman, Ltd.

[57] ABSTRACT

Table saw accessories are shown that are easily mounted on a saw in use or a new saw for the purpose of reducing loads generated on the table saw blade during a sawing operation. Included are a spreading clip that can be pressed onto the leading edge portion of an existing kerf splitter to provide a quick and easy way to change the width of the kerf splitter; and an anti-friction add-on that is easily attached to an existing saw fence.

2 Claims, 2 Drawing Sheets

TABLE SAW ACCESSORIES FOR IMPROVED OPERABILITY

BACKGROUND OF THE INVENTION

1. Field of the Invention

The present invention relates to table saw accessories which improve the operability of a new saw or a saw in use. More specifically, the invention relates to a saw fence anti-friction add-on, and an anti-seize spreading clip which are both easily added on to a new saw or a saw in use for improving the operability of the table saw by reducing loads on the saw blade, the motor and the work piece during the sawing operation.

2. Related Art

Adjustable fences for saw tables are well known in the art, as illustrated by U.S. Pat. No. 4,558,618 to Bachmann et al., and U.S. Pat. No. 4,593,590 to Gray. Table saw fences, as shown in the prior art, are typically straight, elongate, horizontally extending, upwardly projecting work guiding and/or work stop parts which serve to orient work and to assist the operator of the table saw to work across the top of the table and relative to the work performing saw blade. These fences are supported on the top surface of a flat, horizontal, work supporting surface having a vertical slot-like blade opening through which a disk shaped saw blade carried by the shaft of a motor projects to perform work on a work piece. The operator of the table saw pushes the work piece along the guiding surface of the fence and into contact with the portion of the saw blade projecting upwards through the table in order to produce a saw cut through the work piece at a predetermined, constant dimension from a surface of the work piece guided by the fence. Existing table saws also include a saw guard which extends over the top of the saw blade and partially down along the sides of the saw blade in order to prevent accidental contact by the operator with the cutting surfaces of the saw blade.

It is also well known in the table saw art to provide a table saw with a kerf splitter as shown in U.S. Pat. No. 482,507 to Foster and U.S. Pat. No. 565,940 to Stevens et al. As shown in the prior art, kerf splitters generally consist of a thin piece of metal mounted to the work surface of a saw table and positioned to enter the saw cut in a work piece produced by a disk shaped saw blade projecting through the saw table. The kerf splitter is arranged in the same plane as the saw blade and enters the saw cut in order to prevent the kerf produced in the work piece from closing after the saw blade has passed through it—thereby reducing the loads on the saw, the motor and the work piece.

The above described table saw accessories have the inherent disadvantage in that no means are provided for conveniently changing the width of the kerf splitter in order to accommodate saw blades of various thicknessess and the existing adjustable saw fences are not provided with a means for reducing the surface friction generated by the work piece against the contact area on the guiding surface of the saw fence.

SUMMARY OF THE INVENTION

The object of the present invention is to provide table saw accessories which are easily mounted on a saw in use or a new saw for the purpose of reducing loads on the saw blade, the motor and the work piece, and reducing the current required to operate the motor. The proposed accessories provide a means for quickly and efficiently adapting a saw in use or a new saw to have the optimum width kerf splitter for a large number of different width saw blades. The proposed accessories also reduce the surface contact friction between a work piece and the saw blade or a work piece and the saw fence generated during a cutting operation, thereby overcoming the above-mentioned disadvantages of the prior art devices.

BRIEF DESCRIPTION OF THE DRAWINGS

The invention is better understood by reading the following Detailed Description of the Preferred Embodiments with reference to the accompanying drawing figures, in which like reference numerals refer to like elements throughout, and in which:

FIG. 5 illustrates an isometric view of the work surface of a table saw including a work piece, a saw guard, a saw blade (shown in phantom), a kerf splitter with anti-seize spreading clip, and a saw fence with anti-friction add-on.

FIG. 6 illustrates a side elevation view of a saw fence with anti-friction add-on.

DETAILED DESCRIPTION OF THE PREFERRED EMBODIMENTS

Figure 1A:
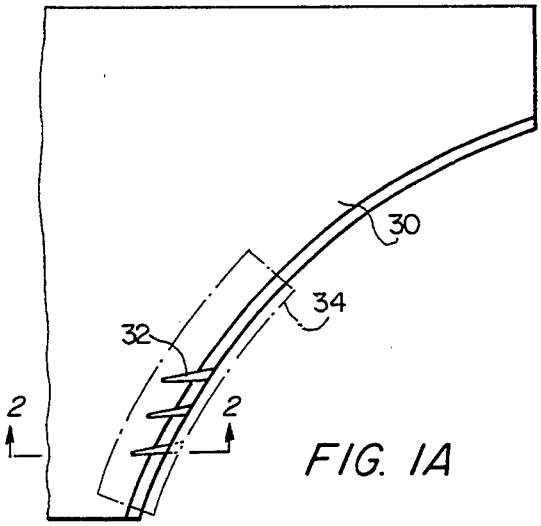
FIG. 1A illustrates a side elevation view of a first embodiment of the anti-seize spreading clip mounted on an existing kerf splitter.

In describing preferred embodiments of the present invention illustrated in the drawings, specific terminology is employed for the sake of clarity. However, the invention is not intended to be limited to the specific terminology so selected, and it is to be understood that each specific element includes all technical equivalents which operate in a similar manner to accomplish a similar purpose.

Figure 2:
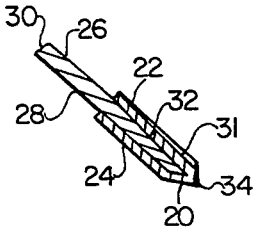
FIG. 2 illustrates a cross sectional view taken along line 2—2 of FIG. 1A.

A first preferred embodiment of the anti-seize spreading clip of the present invention is shown in FIG. 1A. Spreading clip 20 is formed essentially from a longitudinally extending, flat, mild steel plate that is bent about its longitudinal axis into a U shape, as shown in FIG. 2, and deformed so that its longitudinal axis follows a curve as shown in FIG. 1A. Facing leg portions 22 and 24 of spreading clip 20 are spaced apart in parallel relationship so that they fit closely over opposite side surfaces 26 and 28 on an existing kerf splitter 30.

The existing kerf splitter can be replaced with a thinner kerf splitter so that when the proposed anti-seize spreading clip is added to the kerf splitter a wider range of saw blade widths can be accommodated. A preferred embodiment includes replacing the existing kerf splitter with a kerf splitter having a thickness of 0.040 inch and a Rockwell hardness equal to C-60.

As shown in FIG. 2, the proposed anti-seize spreading clip extends rearwardly from the leading edge of the kerf splitter for a distance much shorter than the length of the existing kerf splitter. As a result, the total surface contact area existing between the anti-seize spreading clip and the work piece will be only a small fraction of the total surface contact area that exists between a standard kerf splitter and the work piece. This feature reduces the friction generated during a cutting operation. Furthermore, the provision of an anti-seize spreading clip that can be easily replaced with another clip having a different thickness ensures the adaptability of the table saw to a variety of saw blades having different thicknesses. The present invention contemplates a set of anti-seize spreading clips having a variety of thicknesses being provided to correspond with a variety of thicknesses of saw blades.

In a preferred embodiment, leg portion 22 of spreading clip 20 is deformed to form one or more of inwardly extending protrusions 31. Inwardly extending protrusions 31 also extend in approximately parallel relationship to each other rearwardly from leading edge 34 of spreading clip 20, and are matingly received in matching depressed grooves 32 in kerf splitter side surface 26, as shown in FIG. 2. When spreading clip 20 is positioned over kerf splitter 30 with protrusions 31 engaged in grooves 32, spreading clip 20 is prevented from being shifted by a work piece during the cutting operation.

When spreading clip 20 is positioned on kerf splitter 30 the thickness of the portion of kerf splitter 30 that enters a saw cut formed in a work piece 36 by saw blade 38 is consequently increased by twice the thickness of the plate from which spreading clip 20 is formed, as is apparent from viewing FIG. 2. Because spreading clip 20 can be easily mounted and dismounted on kerf splitter 30 by applying a relatively small pressure to the spreading clip, a simple and efficient method for varying the width of a kerf splitter to correspond with a given saw blade width, and to thereby minimize the pressure exerted on the saw blade by the work piece, is provided.

Figure 5:
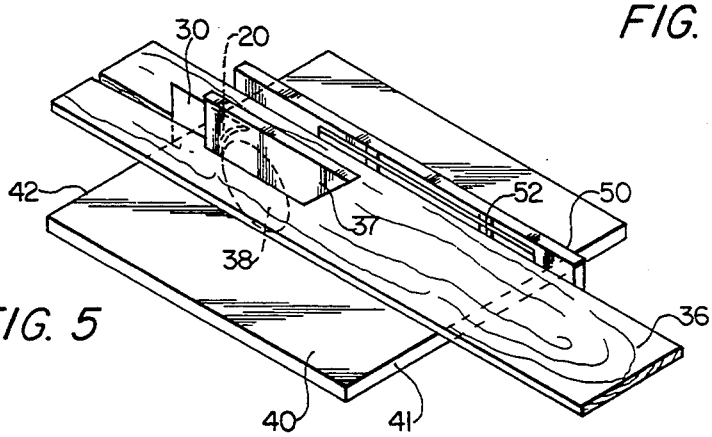
Figure 4:
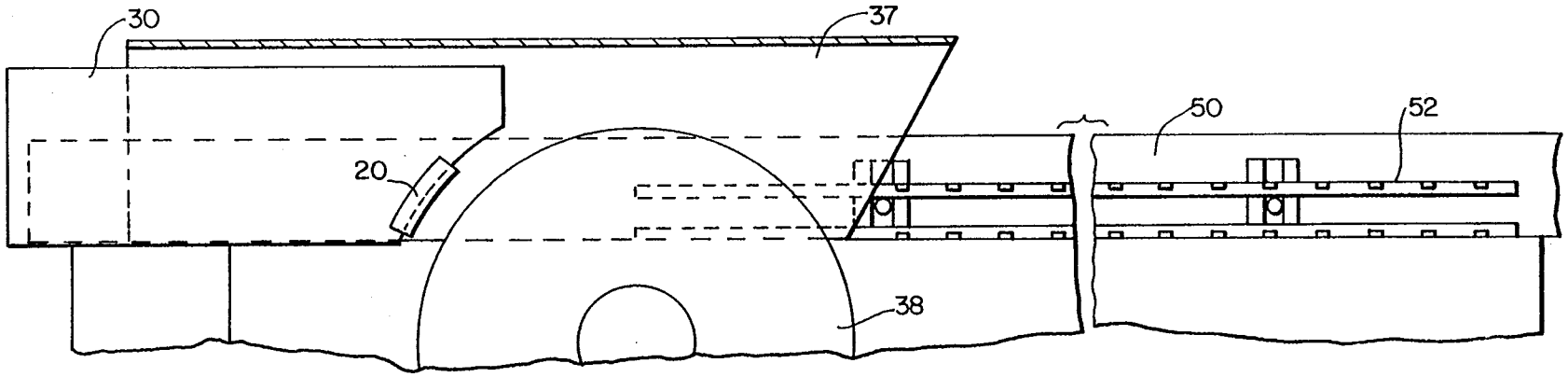
FIG. 4 illustrates a side elevation view showing an anti-seize spreading clip similar to that shown in FIG. 1A mounted on an existing kerf splitter and an existing saw fence mounted on the work surface of a saw table and having saw fence anti-friction add-ons.

FIG. 5 shows a table saw with the addition of a preferred embodiment of the present invention for improved operability. Work piece 36 is placed on top surface 40 and is moved in from front edge 41 of the table to pass over top of the portion of saw blade 38 extending upwardly through the table and covered by saw guard 37. Workpiece 36 is guided by top surface 40 of the table and by a saw fence 50 having an anti-friction add-on 52 to be described in detail below.

Sawblade 38 extends upwardly through the table. As work piece 36 is pushed over saw blade 38 towards back edge 42 of the table, a saw cut is formed in the work piece. A kerf splitter 30 extends inwardly from back edge 42 of the table and lies in a plane in alignment with the plane of saw blade 38. The spreading clip 20 of the present invention is selected from a set of spreading clips having different thicknesses to correspond with a wide range of saw blade thicknesses. A spreading clip is selected so that the total width of the existing kerf splitter plus the anti-seize spreading clip equals the width of the kerf generated by the saw blade currently mounted on the table saw. When pressed onto the front edge of kerf splitter 30, the anti-seize spreading clip 20 enters the saw cut behind the saw blade 38 and prevents the kerf produced in work piece 36 from closing behind the saw blade and thereby reduces the pressure that is produced on saw blade 38 and work piece 36. The spreading clip also provides the advantage over existing kerf splitters of having a reduced surface contact area with the work piece thereby reducing pressure generated on the saw blade during a cutting operation.

Figure 1B:
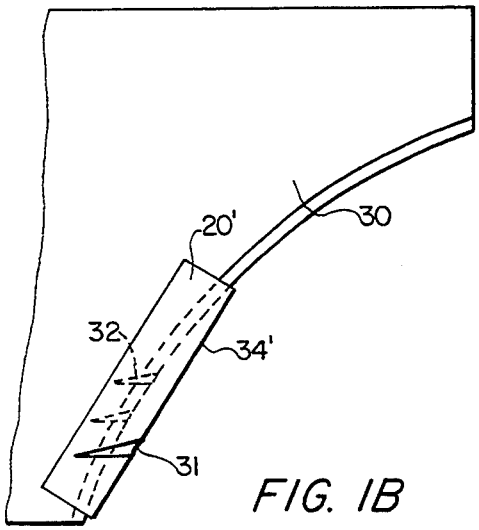
FIG. 1B illustrates a side elevation view of a second embodiment of the anti-seize spreading clip mounted on an existing kerf splitter.

A second embodiment of the spreading clip of the present invention is shown in FIG. 1B. This embodiment of spreading clip 20' is essentially identical to the embodiment shown in FIG. 1*a* with the exception that leading edge 34' of this second embodiment forms a straight line rather than a curve.

Figure 1C:
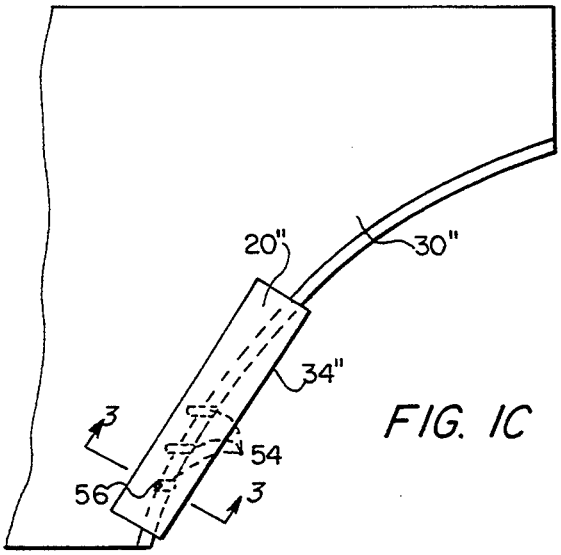
FIG. 1C illustrates a side elevation view of a third embodiment of the anti-seize spreading clip mounted on an existing kerf splitter.
Figure 3:
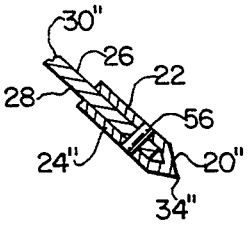
FIG. 3 illustrates a cross sectional view taken along line 3—3 of FIG. 1C.

A third embodiment of the spreading clip of the present invention is shown in FIG. 1C. This embodiment, which includes straight edge 34'', is identical to the spreading clip shown in FIG. 1B, with the exception of the means for attaching the spreading clip to the existing kerf splitter. A plurality of parallel horizontally extending slots 54 are machined in from the edge of kerf splitter 30'' which receives spreading clip 20. Dowel pins 56 can be connected between spreading clip leg portions 22'' and 24'' in spaced, parallel relationship by pressing them through two aligned holes in each of the spreading clip leg portions so that they are flush with outer surfaces of the spreading clip leg portions, and spot welding them in place as shown in FIG. 3. The portions of dowel pins 56 extending between spreading clip leg portions 22'' and 24'' are accepted into respective kerf splitter slots 54 when spreading clip 20'' is pressed onto existing kerf splitter 30'' as shown in FIG. 1C.

Figure 7:
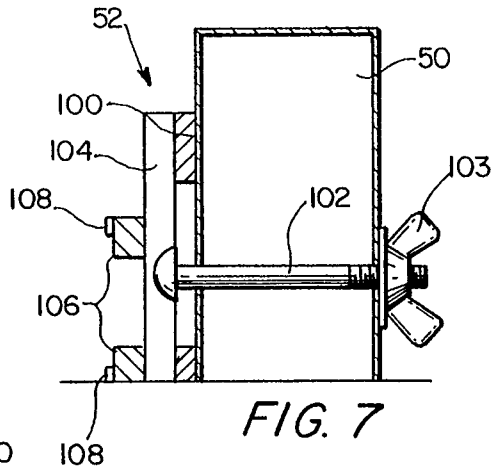
FIG. 7 illustrates a cross sectional view taken along line 7—7 of FIG. 6.
Figure 8:
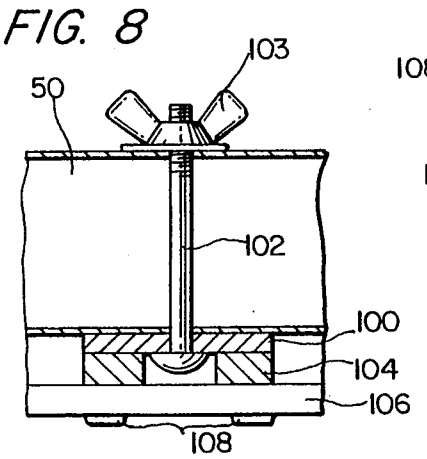
FIG. 8 illustrates a cross sectional view taken along line 8—8 of FIG. 6.
Figure 6:
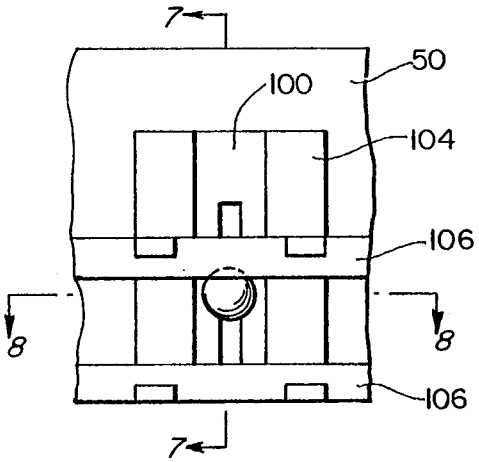

An additional means for reducing the loads produced on the saw blade and the work piece during a sawing operation is shown in FIGS. 6–8. This feature consists of a saw fence anti-friction add-on. As a work piece 36 is guided along existing saw fence 50, the surface contact area between workpiece 36 and saw fence 50 determines the amount of friction produced as work piece 36 is guided along saw fence 50. To reduce the friction between work piece 36 and fence 50 a proposed anti-friction add-on consists of metal rods that are easily bolted to existing saw fence 50 and are adjustable relative to saw fence 50.

A plurality of vertical metal plates 100 are provided with a vertical slot therethrough for receiving a bolt 102 that, along with wing nut 103, serves to attach anti-friction vertical plates 100 to the guiding surface of existing saw fence 50 as shown in FIGS. 7 and 8. Vertical spacer bars 104 are welded along opposite vertical edges of anti-friction vertical plate 100, as shown in FIG. 8. Spacer bars 104 support parallel, horizontally extending guide rods 106. Guide rods 106 are held parallel to existing fence 50 when this anti-friction add on is assembled, and effectively reduce the surface contact area between a work piece 36 and the fence, thereby reducing the pressure that is placed on work piece 36 during the sawing operation.

A preferred embodiment of the present invention contemplates mounting horizontally extending guide rods 106 on an existing saw fence so that they extend from a point adjacent table top front edge 41 rearwardly to a point in approximate alignment with the center rotational axis of saw blade 38. Furthermore, the vertical position of horizontal guide rods 106 can be adjusted by loosening bolt 102 and wing nut 103 and placing a piece of wood of predetermined thickness underneath vertical plate 100 and spacer bars 104 to raise or lower the entire anti-friction add on assembly relative to the existing saw fence. Guide rod protrusions 108 can be optionally provided at spaced intervals along guide rods 106 and integral with guide rods 106 in order to further reduce the surface contact area between work piece 36 and the saw fence, as shown in FIG. 8.

Modifications and variations of the above-described embodiments of the present invention are possible, as appreciated by those skilled in the art in light of the above teachings. For example, the exact means for adjusting the vertical position of the anti-friction add on can be varied and the selection of exact thicknesses of the anti-seize spreading clips provided can be varied.

It is therefore to be understood that, within the scope of the appended claims and their equivalents, the invention may be practiced otherwise than as specifically described.

What is claimed is:

1. A table saw comprising:

a table;

a saw blade mounted on said table for producing a saw cut in a work piece;

a saw fence mounted on said table adjacent said saw blade, said saw fence having a work piece guiding surface;

means for reducing a total surface area of said work piece guiding surface, with said means for reducing the total surface area being provided with means for being demountably fastened to said saw fence;

a kerf mounted on said saw table and splitter having a leading edge for entering the saw cut in the work piece behind said saw blade; and a spreading clip mounted on said kerf splitter leading edge, wherein said spreading clip has a thickness corresponding to a thickness of said saw blade.

2. The table saw of claim 1 wherein said means for reducing the total surface area includes:

a spacer plate having means for being demountably fastened to said work piece guiding surface;

vertical spacer bars connected to said spacer plate; and horizontal guide rods connected to said vertical spacer bars, with said guide rods forming a second work piece guiding surface.

* * * * *

UNITED STATES PATENT AND TRADEMARK OFFICE

CERTIFICATE OF CORRECTION

PATENT NO. : 5,447,085

DATED : September 5, 1995

INVENTOR(S) : Marshall GOCHNAUER

It is certified that error appears in the above-indentified patent and that said Letters Patent is hereby corrected as shown below:

Column 4, line 23, please replace "20" with --20"--;

Column 6, line 10, after "kerf", please insert --splitter--; and after "and", delete "splitter";

line 18, delete "spacer"; and line 20, delete "spacer".

Signed and Sealed this

Ninth Day of January, 1996

*Attest:*

Bruce Lehman

BRUCE LEHMAN

*Attesting Officer*

*Commissioner of Patents and Trademarks*